US006042791A

United States Patent [19]

Johnson et al.

[11] Patent Number: 6,042,791

[45] Date of Patent: Mar. 28, 2000

[54] PRESSURE AND VOC CONCENTRATION WAVE DAMPING FOR A THERMAL OXIDIZER

[76] Inventors: Allan M. Johnson, 1524 S. McAllister St., Kanab, Utah 84741; Allan M. Johnson, Jr., 26325 Belle Porte Ave., Harbor City, Calif. 90710

[21] Appl. No.: 09/063,495

[22] Filed: Apr. 20, 1998

[51] Int. Cl.[7] ..... F01N 3/10

[52] U.S. Cl. ..... 422/173; 422/114; 422/115; 422/198; 422/113; 110/210; 110/214; 110/235

[58] Field of Search ..... 422/173, 175, 422/198, 105, 110, 114, 115, 113; 110/235, 245, 214, 345, 210

[56] References Cited

U.S. PATENT DOCUMENTS

| | | | |
|---|---|---|---|
| 5,088,424 | 2/1992 | Sardari et al. | 110/345 |
| 5,215,018 | 6/1993 | Sardari et al. | 110/235 |

*Primary Examiner*—Hien Tran
*Attorney, Agent, or Firm*—Stout, Uxa, Buyan & Mullins, LLP; Donald E. Stout

[57] ABSTRACT

Apparatus and methods for modulating or damping surges of gaseous component (VOC) to a system for destroying the gaseous component are provided which include an accumulator located and adapted to hold gaseous component resulting from such a surge. The present system includes a valve which is positioned to facilitate passing the gaseous component resulting from the surge to the accumulator and, thereafter, to be repositioned to allow the gaseous component from the accumulator to be passed to the system for destroying the gaseous component.

8 Claims, 2 Drawing Sheets

PRESSURE AND VOC CONCENTRATION WAVE DAMPING FOR A THERMAL OXIDIZER

BACKGROUND OF THE INVENTION

The present invention relates to apparatus and methods for damping surges, for example, velocity surges and/or pressure surges and/or concentration surges, of gaseous component, for example, volatile organic compounds (VOC), to a system for destroying gaseous component, for example, a thermal oxidizer. In particular, the present invention relates to apparatus and methods for damping surges of gaseous component to facilitate the operation of a system in which the gaseous component is destroyed, and preferably is made more environmentally acceptable.

A large body of technology has been developed directed to systems for reducing emissions of gaseous components, such as VOC, to the atmosphere. In many of these systems, the gaseous component is destroyed and/or rendered more environmentally acceptable. For example, the gaseous component is placed in a thermal oxidizer with oxygen at a sufficiently high temperature to facilitate the combustion of the gaseous component, for example, to carbon dioxide and water. At steady state operation, in which the amount of gaseous component to be destroyed is maintained substantially constant, such destruction systems are very effective and efficient in greatly reducing atmospheric emissions of gaseous component, e.g., VOC.

However, the processes which produce such gaseous components which are to be destroyed may inadvertently, or even purposefully or intentionally, provide surges, for example, velocity surges and/or pressure surges and/or concentration surges, of the gaseous component to be destroyed. Such surges can have a detrimental effect on the gaseous component destruction system. For example, a surge of gaseous component introduced directly into a system for destroying gaseous component can upset the operation, such as the temperature, residence time, other process conditions and the like, of such a destruction system, which can result in reduced destruction system effectiveness and efficiency, and ultimately in increased atmospheric pollution.

It would be advantageous to provide for damping the effect of such gaseous component surges on systems for destroying such gaseous component.

SUMMARY OF THE INVENTION

New apparatus and methods for modulating or damping surges of gaseous component, for example, VOC, to a system for destroying such gaseous component have been discovered. The present apparatus and methods are very effective, are straightforward in construction and operation and provide a cost effective way of handling surges of gaseous components while reducing the detrimental effects of such surges on the effectiveness and efficiency of the gas component destruction system. Ultimately, the present apparatus and methods facilitate maintaining a high degree of gaseous component destruction and atmospheric emission control in spite of the occurrence of one or more surges of gaseous component.

In one broad aspect, the present invention relates to apparatus for modulating or damping surges of gaseous component to a system for destroying gaseous component and comprises a conduit assembly, a restrictor valve and an accumulator. The conduit assembly, for example, a plurality of interconnected pipes adapted to transport gas, is positioned to connect, e.g., provide fluid communication between, a source of surges of gaseous component with a system for destroying gaseous component. The restrictor valve is located in the conduit assembly downstream of the source of surges of gaseous component and has a first position in which gaseous component flows, preferably flows substantially freely, in the conduit assembly across the restrictor valve, and a second position in which the restrictor valve provides an increased restriction on the flow of gaseous component through the conduit assembly relative to the first position of the restrictor valve. The accumulator is in fluid communication with the conduit assembly upstream of the restrictor valve. This accumulator is located and adapted to hold gaseous component from the source of surges of gaseous component.

As used herein, the term "source of surges of gaseous component" refers to any assembly or sub-system which produces one or more surges in the amount, for example, pressure and/or concentration surges, of gaseous component to the system for destroying gaseous component. Such source of surges of gaseous component often operates for a large portion of the time at a steady state, that is so that no gaseous component or a constant amount of gaseous component is passed to the destruction system. However, the surge source, for example, on a regular or periodic or even random basis, produces a surge of gaseous component to the system for destroying gaseous component. Many surge sources are employed in industry. Examples of surge sources include, but are not limited to, batch expanders and block molders for expanded polymeric materials, such as expanded polystyrene, in which the gaseous material used to expand the polymer is a VOC, such as a volatile hydrocarbon, which is to be destroyed.

The present apparatus is structured so that at least a portion, such as a significant portion, for example at least about 30% and preferably at least about 50%, of the gaseous component produced during the surge of gaseous component is fed to the accumulator where it is held. After the surge, the gaseous component from the surge located in the accumulator preferably is passed to the destruction system over a reasonable period of time and at a lower flow rate relative to a system without the accumulator. Because of this modulating or damping of the surge of gaseous component, the effectiveness and efficiency of the destruction system is maintained to a greater extent than if the surge of gaseous component is fed directly to the destruction system. The destruction system preferably functions so as to be effective and efficient in providing environmentally acceptable atmospheric emissions in spite of the surge of gaseous component from the source of such surges. In other words, the present invention reduces the detrimental effect or effects on the destruction system caused by such surges of gaseous component.

The restrictor valve preferably is in the second or restricted position during the time the source of surges of gaseous component provides a surge of gaseous component. More preferably, the restrictor valve is structured to move from the second position to the first position after the valve is moved to the second position, for example, after the surge has abated. The restrictor valve is preferably structured to be automatically, i.e., without direct human intervention, between the first and second positions, for example, to be automatically moved to the second position in response to or in anticipation of a surge of gaseous component from the surge source being provided to the conduit assembly.

The gaseous component upstream of the restrictor valve preferably is made to enter the accumulator and to exit the accumulator through a single passageway in fluid communication with the conduit assembly. This single control point feature simplifies the operation and control of the present apparatus and makes it more effective and efficient.

In a particularly useful embodiment, the accumulator comprises a flexible bag, for example, made of a gas impermeable polymeric material, defining a chamber adapted for holding gaseous component from the source of surges of gaseous component. A rigid box preferably is provided substantially surrounding this flexible bag. Thus, the accumulator has the ability to expand and contract, to receive and hold gaseous component when this is needed and to facilitate passing gaseous component from the accumulator into the conduit assembly and destruction system when such passing is desirable. The rigid box protects the flexible bag and provides a substantial degree of structural support for the flexible bag.

In a very useful embodiment, the present apparatus preferably further comprises a surge valve in fluid communication with the source of surges of gaseous component. This surge valve is connected to the conduit assembly, and preferably is in the conduit assembly, upstream of the accumulator. The surge valve is adapted to be opened to provide a surge of gaseous component to the conduit assembly from the source of surges of gaseous component. In one embodiment, the opening of the surge valve, for example, a pressure relief valve, produces a signal which is passed to a control module which, in turn, passes a signal to the restrictor valve, causing the restrictor valve to move to the second, restricted position. Alternately, the surge valve is adapted to be opened in response to a signal and the restrictor valve is adapted to be moved to the second position in response to the same signal. In both of these embodiments, and preferably, the surge valve is opened and the restrictor valve is moved to the second position substantially simultaneously.

In another broad aspect of the present invention, methods for damping surges of gaseous component to a system for destroying gaseous component are provided. These methods comprise providing a surge of gaseous component in a conduit assembly in fluid communication with a system for destroying gaseous component, causing the flow of gaseous component in the conduit assembly to be restricted, and passing gaseous component from the surge of gaseous component into an accumulator in fluid communication with the conduit assembly upstream of the system for destroying gaseous component.

Preferably, the causing step of the present methods includes partially closing a restrictor valve in the conduit assembly which is located downstream of the accumulator. More preferably, the opening of the surge valve and the partial closing of the restrictor valve occur substantially simultaneously. The surge valve under normal conditions, that is when no surge of gaseous component is being provided, preferably is closed to prevent gaseous component from the source of surges of gaseous component entering the conduit assembly downstream of the surge valve. When the surge valve is closed, the restrictor valve is preferably open to reduce the restriction on flow of gaseous component on the conduit assembly. The present apparatus may be used in practicing the present methods.

The present methods preferably further comprise allowing gaseous component from the accumulator to pass through the conduit assembly to the system for destroying gaseous component. Such allowing step preferably includes reducing the extent to which the flow of gaseous component in the conduit assembly is restricted. For example, the allowing step may include causing the flow of gaseous component to be substantially unrestricted.

The providing step preferably includes opening a surge valve in the conduit assembly to allow gaseous component from a source of surges of gaseous component to enter the conduit assembly.

The present invention is useful with any system for destroying gaseous component. Such systems may involve oxidation and/or other chemical or physical reaction to destroy the gaseous component or render it more environmentally acceptable. The destruction system preferably involves oxidizing the gaseous component, for example, catalytically and/or thermally. A particularly useful destruction system includes a regenerative thermal oxidizer, for example, a regenerative thermal oxidizer of conventional design.

Each and every feature disclosed herein is within the scope of the present invention. Moreover, each and every combination of two or more of such features which are not mutually inconsistent are included within the scope of the present invention.

These and other aspects and advantages of the present invention are apparent in the following detailed description and claims, particularly when considered in conjunction with the drawings in which like parts bear like reference numerals.

DETAILED DESCRIPTION OF A PREFERRED EMBODIMENT OF THE INVENTION

Figure 1:
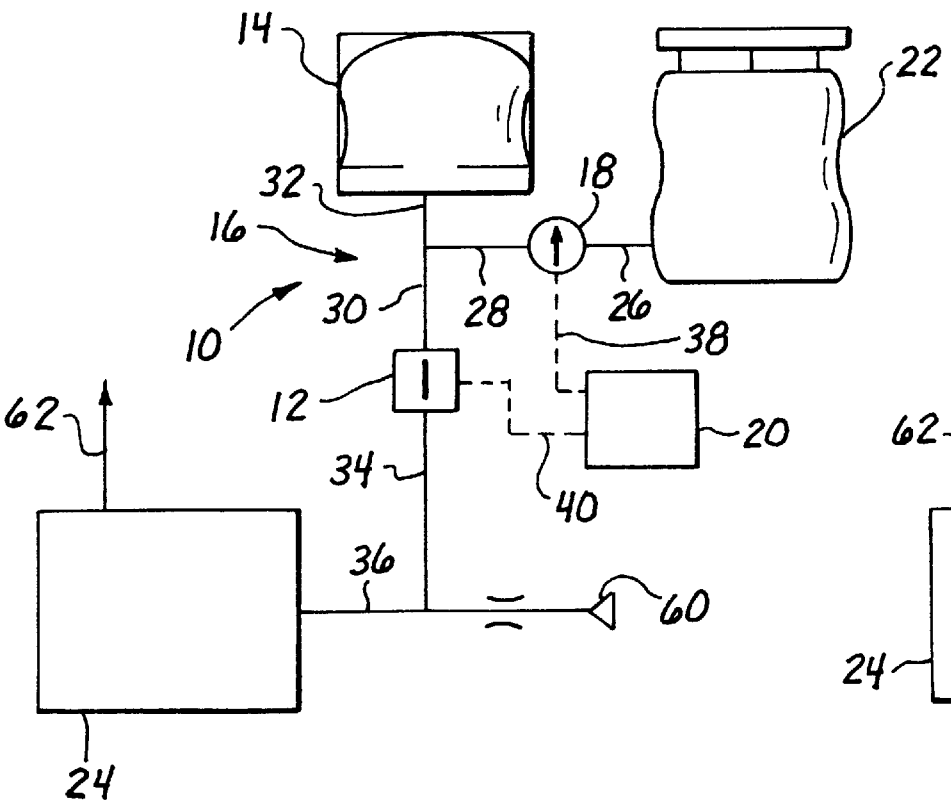
FIG. 1 is a schematic illustration of an embodiment of the present apparatus with the restrictor valve in the first position.

Referring now to FIG. 1, the present surge modulating or damping apparatus, shown generally at 10, includes a restrictor valve 12, an accumulator 14 and a piping assembly, shown generally at 16. In addition, the present system 10 includes a surge valve 18 and a control module 20. In general, system 10 modulates or dampens surges of VOC, e.g., hydrocarbon material, such as pentane, from a batch expander 22 as such VOC surges are passed to a regenerative thermal oxidizer (RTO) 24 to be oxidized or combusted, e.g., to carbon dioxide and water.

Piping assembly 16 includes piping segment 26 which provides fluid communication from the batch expander 22 to the surge valve 18. Piping segments 28 and 30 of piping assembly 16 provide fluid communication between the surge valve 18 and the restrictor valve 12. Piping segments 28 and 32 of piping assembly 16 provide fluid communication between surge valve 18 and accumulator 14. Piping segments 34 and 36 of piping assembly 16 provide fluid communication between restrictor valve 12 and the RTO 24.

Control module 20, for example, a programmable controller of conventional design, provides signals to the surge valve 18 through signal line 38 and to the restrictor valve 12 through signal line 40. Each of surge valve 18 and restrictor valve 12 changes position based upon signals received from control module 20. Preferably, signals are passed through signal line 38 and signal line 40 at substantially the same time and, therefore, in this sense may be considered to be the same signal.

Restrictor valve 12 is within piping assembly 10 and may be of conventional design provided that it is movable in response to signals passed through signal line 40. Similarly, surge valve 18 in conduit assembly 10 may be of conventional design provided that it is movable in response to signals passed through signal line 38.

Figure 3:
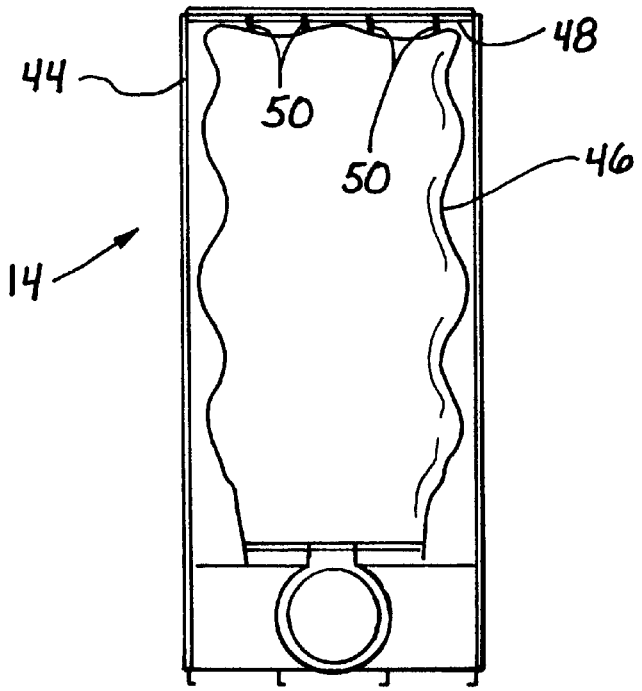
FIG. 3 is a front view, in partial cross section, of the accumulator of the embodiment shown in FIG. 1.
Figure 4:
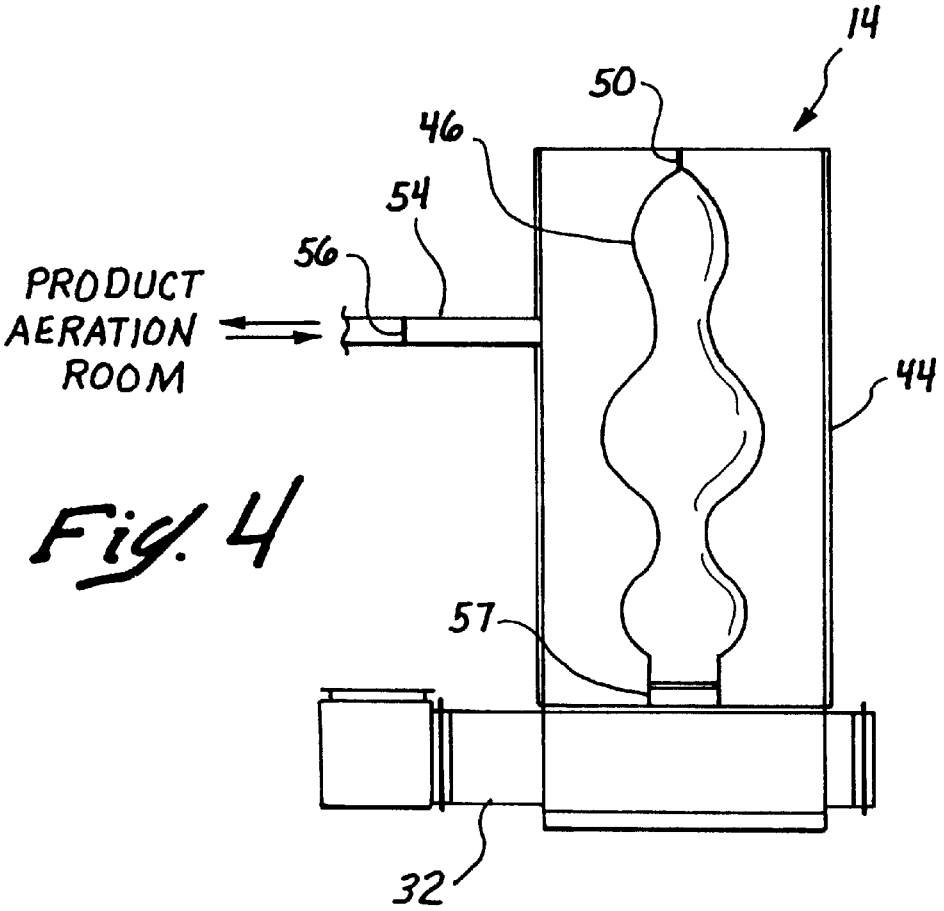
FIG. 4 is a side view, in partial cross section, of the accumulator of the embodiment shown in FIG. 1.

With more specific reference to FIGS. 3 and 4, accumulator 14 comprises a substantially rigid, hollow box like structure 44 which surrounds a flexible bag 46, for example, made of gas impermeable polymeric material, such as a fabric coated with polyester and the like materials. The bag 46 is secured to the interior top wall 48 of box 44 using a series of hangers 50. As shown in FIG. 4, flexible bag 46 is adapted to contract within box 44 and also to expand within the box. An outlet line 54 is provided with an adjustable damper 56. Outlet line 54 provides fluid communication between the interior of box 44 and a source of VOC, such as a product aeration room. Thus, when the bag 46 is expanding into the space defined by the box 44, gas from the box 44 outside the bag 46 passes into outlet line 54 across adjustable damper 56 and into the aeration room where it is stored or maintained. When gaseous material is exiting bag 46 through outlet 57 into piping segment 32, gas from the product aeration room passes through line 54 across damper 56 and into the box 44 outside the bag 46. It should be noted that the gas from the interior of box 44 outside of bag 46 can be effectively handled or managed in other ways than as outlined above. For example, this gas may be passed to a separate system for processing, or may be passed directly to the atmosphere.

The RTO 24 may be of conventional design and operates to oxidize VOC from piping segment 34 and VOC source 60. The products of this combustion, for example, substantially totally carbon dioxide and water, are released to the atmosphere through exhaust line 62. VOC source 60 comprises one or more VOC-containing streams which are processed in the RTO 24. VOC source 60 may include one or more steady state (constant) VOC-containing streams, one or more non-steady state (fluctuating) VOC-containing streams or a combination of steady state and non-steady state VOC-containing streams. In addition, VOC source 60 includes sufficient oxygen, for example, in the form of air, to at least partially, preferably totally, combust the VOC in piping segment 36. The RTO 24 may, and preferably does, include a blower to force the gas in piping segment 36 through the RTO. An additional source of oxygen may be provided in RTO 24 to insure substantially complete combustion of the VOC.

FIG. 1 illustrates a mode of operation of system 10 in which the surge valve 18 is closed and the restrictor valve 12 is completely open. In this mode of operation, gaseous material from flexible bag 46 exits through segment 32 across restrictor valve 12 through segment 34 and segment 36 into RTO 24 where it is combusted to produce exhaust gas in line 62. If no gas is present in flexible bag 46, no gas is passed to the RTO 24 from system 10.

However, when batch expander 22 is to be decompressed, control module 20 provides signals through signal lines 38 and 40 to surge valve 18 and restrictor valve 12, respectively. Such signals cause surge valve 18 to open and restrictor valve 12 to partially close, thereby increasing the amount of restriction to the flow of gas across the restrictor valve. This mode of operation is shown in FIG. 2.

The opening of surge valve 18 creates a surge of VOC from batch expander 22 flowing in pipe segment 26 across surge valve 18 and into segment 28. Because restrictor valve 12 now provides an increased restriction to gas flow across the restrictor valve, a significant portion, for example, at least about 30% and preferably at least about 50%, of the gaseous component in segment 28 is routed through segment 32 into flexible bag 46 of accumulator 14. The configuration as shown in FIG. 2 remains in place until the surge valve 18 is closed, for example, by another signal, after a predetermined time, from control module 20 through signal line 38. Preferably, at substantially the same time that surge valve 18 is closed, restrictor valve 12 is opened, for example, by a signal from control module 20 through signal line 40. This configuration is shown in FIG. 1.

Figure 2:
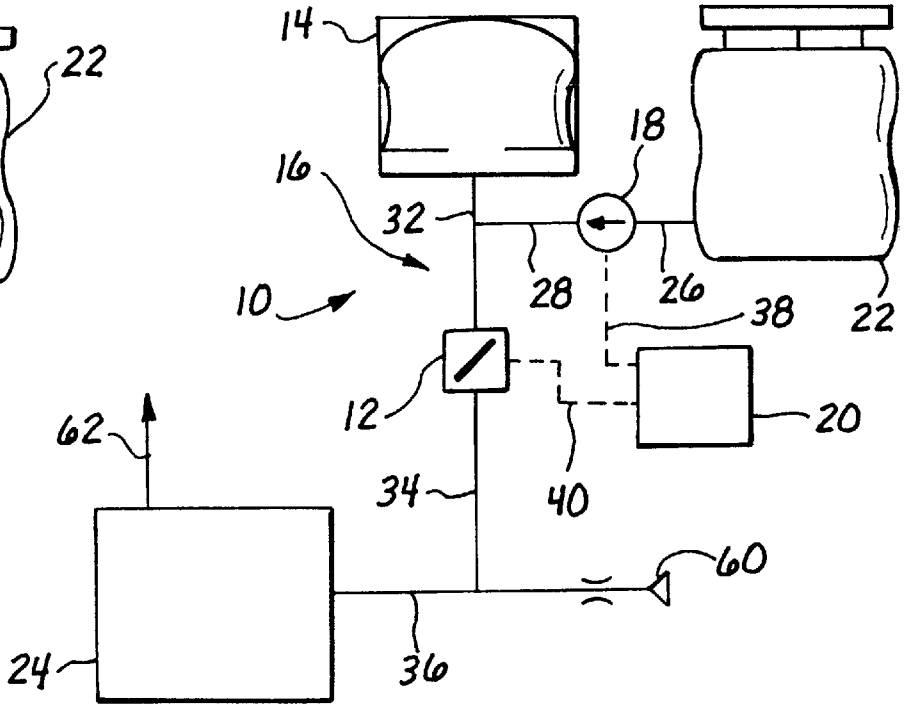
FIG. 2 is a schematic illustration of the embodiment shown in FIG. 1 with the restrictor valve in the second position.

During the time the system 10 is in the configuration shown in FIG. 2, the amount of gaseous component passing into RTO 24 through segment 36 is reduced relative to a system under similar surge conditions without accumulator 14 and restrictor valve 12. System 10 modulates or dampens the surge of VOC from batch expander 22, thereby reducing the detrimental effect on the RTO 24 caused by the surge.

After the surge and after the system is placed in the configuration shown in FIG. 1, the VOC from the flexible bag 46 is passed across restrictor valve 12 and into RTO 24, as described above, to combust this material and provide exhaust gas through exhaust line 62.

In the above described embodiment it is assumed that the surges from batch expander 22 occur at regular or periodic intervals and therefore can be controlled by control module 20. However, the present system may also be employed to modulate or dampen surges which occur on a random basis.

For example, the surge valve 18 may be connected to a reactor or other pressure vessel and be in the form of a pressure relief valve. When the pressure relief valve is opened (to relieve a random high pressure condition), it provides a signal to control module 20 which, in turn, provides a signal to restrictor valve 12 to partially close. Thus, during this pressure relief (surge) situation, the system 10 is moved to substantially the configuration shown in FIG. 2. Once the pressure has been relieved, the surge valve 18 (pressure relief valve) is returned to the closed position, and provides a signal to control module 20 which, in turn, provides a signal to restrictor valve 12, which opens. The system 10 is then in a configuration similar to that shown in FIG. 1.

Thus, as illustrated directly above, the operation of the present system in a pressure relief or other random surge situation is similar to the system operation for handling regular surges of VOC from batch expander 22.

The present system modulates or dampens surges of gaseous component (VOC) being passed to a system for destroying the gaseous component. This reduces the detrimental effect of this gaseous component surge on the destruction system and, ultimately, provides for reduced amounts of harmful atmospheric emissions. The present system may be used with a wide variety of sources of surges of gaseous component. Such sources may provide regular or periodic surges of gaseous component and/or may provide random surges of gaseous component. In any event, the present system modulates or dampens the surge of gaseous component and provides for more effective and efficient destruction of the gaseous component.

While this invention has been described with respect to various specific examples and embodiments, it is to be understood that the invention is not limited thereto and that it can be variously practiced within the scope of the following claims.

What is claimed is:

1. An apparatus for damping surges of gaseous component to a system for destroying gaseous component, said apparatus comprising:

a conduit assembly positioned to connect a source of surges of gaseous component with a system for destroying gaseous component;

a restrictor valve located in said conduit assembly downstream from the source of surges of gaseous component and having a first position in which gaseous component flows in said conduit assembly across said restrictor valve and a second position in which said restrictor valve provides an increased restriction on the flow of gaseous component through said conduit assembly relative to the first position of said restrictor valve; and an accumulator in fluid communication with said conduit assembly upstream of said restrictor valve, said accumulator being located and adapted to hold gaseous component from the source of surges of gaseous component when the restrictor valve is at the second position, and comprising a flexible bag defining a chamber adapted for holding gaseous component from the source of surges of gaseous component, and a rigid box which substantially surrounds said flexible bag.

2. The apparatus of claim 1 wherein said restrictor valve is in said second position during the time the source of surges of gaseous component provides a surge of gaseous component to said conduit assembly.

3. The apparatus of claim 1 wherein said restrictor valve is adapted to move from said second position to said first position after the source of surges of gaseous component provides a surge of gaseous material to said conduit assembly.

4. The apparatus of claim 1 wherein said first position of said restrictor valve is such that gaseous component flows substantially freely in said conduit assembly across said restrictor valve.

5. The apparatus of claim 1 wherein said accumulator includes a single passageway through which gaseous component enters and exits.

6. The apparatus of claim 1 which further comprises a surge valve in fluid communication with the source of surges of gaseous component connected to said conduit assembly upstream of said accumulator, said surge valve being adapted to be opened to provide a surge of gaseous component to said conduit assembly from the source of surges of gaseous component.

7. The apparatus of claim 6 wherein said surge valve is adapted to be opened in response to a signal from a control module and said restrictor valve is adapted to be moved to said second position in response to the same signal.

8. An apparatus for damping surges of gaseous component to a system for destroying gaseous component, said apparatus comprising:

a conduit assembly positioned to provide fluid communication between a source of surges of gaseous component and a system for destroying gaseous component;

a restrictor valve located in said conduit assembly downstream from the source of surges of gaseous component and having a first position in which gaseous component flows substantially freely in said conduit assembly across said restrictor valve and a second position in which said restrictor valve provides an increased restriction on the flow of gaseous component through said conduit assembly relative to the first position of said restrictor valve;

an accumulator in fluid communication with said conduit assembly upstream of said restrictor valve, said accumulator located and adapted to hold gaseous component from the source of surges of gaseous component when the restrictor valve is at the second position, said accumulator including a single passageway in fluid communication with said conduit assembly through which gaseous component enters and exits, a flexible bag defining a chamber adapted for holding gaseous component from the source of surges of gaseous component, and a rigid box which substantially surrounds said flexible bag; and a surge valve in said conduit assembly upstream of said accumulator, said surge valve being adapted to be opened to provide a surge of gaseous component to said conduit assembly from the source of surges of gaseous component, said surge valve being adapted to open in response to a signal from a control module and said restrictor valve being adapted to be moved to said second position in response to the same signal.

* * * * *